US009468273B1

(12) United States Patent
Hasselbach et al.

(10) Patent No.: US 9,468,273 B1
(45) Date of Patent: Oct. 18, 2016

(54) RETRACTABLE UMBRELLA

(71) Applicants: Henry J. Hasselbach, Decatur, TX (US); John C. Hasselbach, Decatur, TX (US); Robert G. Snow, Decatur, TX (US)

(72) Inventors: Henry J. Hasselbach, Decatur, TX (US); John C. Hasselbach, Decatur, TX (US); Robert G. Snow, Decatur, TX (US)

( * ) Notice: Subject to any disclaimer, the term of this patent is extended or adjusted under 35 U.S.C. 154(b) by 163 days.

(21) Appl. No.: 14/293,476

(22) Filed: Jun. 2, 2014

Related U.S. Application Data

(60) Provisional application No. 61/858,794, filed on Jul. 26, 2013.

(51) Int. Cl.

| | |
|---|---|
| ***A45B 19/00*** | (2006.01) |
| ***A45B 25/14*** | (2006.01) |
| ***A45B 25/02*** | (2006.01) |
| ***A45B 25/16*** | (2006.01) |

(52) U.S. Cl.
CPC ..... *A45B 19/00* (2013.01); *A45B 25/02* (2013.01); *A45B 25/143* (2013.01); *A45B 25/165* (2013.01); *A45B 2019/001* (2013.01); *A45B 2019/002* (2013.01); *A45B 2019/008* (2013.01)

(58) Field of Classification Search
CPC ..... A45B 19/00; A45B 2019/001; A45B 2019/002; A45B 2019/005; A45B 2019/007; A45B 2019/008; A45B 25/02; A45B 25/143; A45B 25/165
See application file for complete search history.

(56) References Cited

U.S. PATENT DOCUMENTS

| | | | | | |
|---|---|---|---|---|---|
| 3,186,421 | A * | 6/1965 | Wilson | A45B 25/02 | 135/15.1 |
| 3,435,836 | A * | 4/1969 | Vanzini | A45B 19/00 | 135/22 |
| 3,534,752 | A * | 10/1970 | Vanzini | A45B 3/04 | 135/22 |
| 3,709,238 | A * | 1/1973 | Leopoldi | A45B 19/00 | 135/15.1 |
| 3,844,301 | A * | 10/1974 | Harrell | A45B 19/00 | 135/15.1 |
| 4,084,600 | A * | 4/1978 | dePolo | A45B 19/00 | 135/15.1 |
| 4,821,756 | A * | 4/1989 | England | A45B 13/00 | 135/19.5 |
| 4,966,179 | A * | 10/1990 | Baldwin | A45B 13/00 | 135/19.5 |

(Continued)

FOREIGN PATENT DOCUMENTS

| | | | | |
|---|---|---|---|---|
| EP | 1181876 A1 | 2/2002 | | |
| FR | 2681224 A1 * | 3/1993 | | A45B 19/00 |
| GB | 2481001 A * | 12/2011 | | A45B 9/02 |

*Primary Examiner* — David R Dunn
*Assistant Examiner* — Danielle Jackson
(74) *Attorney, Agent, or Firm* — Robert C. Montgomery; Montgomery Patent & Design

(57) ABSTRACT

A retractable umbrella includes a canopy with supporting ribs and a shaft with a handle located on a proximal end thereof. Inside the shaft resides an electric motor and a gearing mechanism for power transmission. When activated, the electric motor actuates the gearing mechanism to extend and retrieve the canopy from and into the shaft.

20 Claims, 6 Drawing Sheets

(56) References Cited

U.S. PATENT DOCUMENTS

| | | | | |
|---|---|---|---|---|
| 5,188,137 | A * | 2/1993 | Simonelli | A45B 25/02 135/19.5 |
| 5,284,803 | A * | 2/1994 | Haisma | H01L 21/2007 148/DIG. 12 |
| 5,690,131 | A * | 11/1997 | Voigt | A45B 19/00 135/19.5 |
| 6,711,769 | B1 | 3/2004 | Jane-Prats | |
| 6,953,043 | B2 | 10/2005 | Yu | |
| 7,581,554 | B2 * | 9/2009 | Glasser | A45B 25/14 135/15.1 |
| 7,861,735 | B2 | 1/2011 | Stepaniuk et al. | |
| 8,011,379 | B2 * | 9/2011 | Oh | A45B 19/04 135/19 |
| 8,225,806 | B1 * | 7/2012 | Simonelli | A45B 25/14 135/19.5 |
| 8,276,606 | B2 | 10/2012 | Chen | |
| 8,387,640 | B2 | 3/2013 | Kim | |
| 2008/0190469 | A1 * | 8/2008 | Amsel | A45B 19/00 135/20.3 |
| 2009/0145469 | A1 * | 6/2009 | Pirlo | A45B 25/143 135/16 |
| 2009/0223545 | A1 * | 9/2009 | Beyer | A45B 19/00 135/31 |
| 2009/0293924 | A1 * | 12/2009 | Ham | A45B 25/143 135/23 |
| 2015/0237975 | A1 * | 8/2015 | Ng | A45B 19/00 135/27 |
| 2015/0245691 | A1 * | 9/2015 | Fitzgerald | A45B 19/00 135/27 |

* cited by examiner

RETRACTABLE UMBRELLA

RELATED APPLICATIONS

The present invention was first described in and claims the benefit of U.S. Provisional Application No. 61/858,794, filed Jul. 26, 2013, the entire disclosures of which are incorporated herein by reference.

FIELD OF THE INVENTION

The present invention relates to a retractable umbrella that deploys and retracts the canopy portion of the umbrella from within a tubular shaft.

BACKGROUND OF THE INVENTION

None will doubt the effectiveness of an umbrella for keeping a person dry while walking in the rain. Their simple but effective design has served mankind well over the years with minimal changes to its basic design. However, all umbrellas suffer from one (1) common flaw in that they must be positioned an arms lengths away from the user's body before deploying. This is to allow the ribs of the umbrella to fold up from the bottom to their protective top position. Such a restriction often means the user must get slightly wet when getting out of a motor vehicle, or stepping outside from a building with no protective awning or overhang. A similar problem exists when returning to a protective space as well. Accordingly, there exists a need for a means by which umbrellas can be deployed and retracted in a radically different manner to address the above mentioned problems. The development of the retractable umbrella fulfills this need.

The apparatus is an umbrella system that deploys from the top down versus the bottom up arrangement of conventional umbrellas. A central tube functions as an umbrella support, a handle, and a storage container. A generally circular canopy, supported by a plurality of ribs is driven in and out of a top of the tube by a central worm gear shaft. Upon reaching maximum deployment, each rib bends downward, as restricted by the canopy, to form a typical umbrella shape. Other components such as pivot bases, a rotating ring, a snap ring, a cap assembly, and a wiper disk aid in this process. Since the canopy extends from the top of the shaft, it can be held close to one's body, thus offering increased protection when contrasted with prior art umbrella systems. The mechanism is powered by a small electric motor, which receives electrical power from batteries located in a shaft portion of the handle. Operation of the invention is controlled by a power switch located near the handle. Various logos, symbols, and graphics could be printed on the canopy as well for marketing purposes.

Prior art in this field consists of automated umbrella systems and umbrella systems having off-set and angled canopies. Umbrella systems with off-set and angled canopies provide limited relief to the problems associated with non-overhead protection during deployment of the canopy. The angled or off-set nature of the canopy affords a user the ability to better position the umbrella in the rain while a user is under the cover of an ancillary structure, but because the canopy of these devices still open by the ribs folding up and out, this provides a limited remedy. Prior art automated umbrella systems employ motors and transmission gearing to extend and retract the canopy, but the canopy is not extended from within, and retracted into, the central shaft of the umbrella. Furthermore, these systems still suffer from the restriction associated with the ribs folding up and out during deployment of the canopy. It is desirous to have an umbrella system that does not employ a rib and canopy configuration that opens radially from a bottom of the central umbrella shaft, but to rather open radially from a top of the central umbrella shaft. It is further desirous to restrict the radial motioning of the ribs to an area that is above a user holding the umbrella so as to obviate the need to hold the umbrella away from a user's body upon deployment of the canopy.

It is an object of this invention to provide an umbrella system that deploys the canopy of the umbrella from a top portion of the central shaft of the umbrella so that the umbrella can be held in close proximity to a user's body during deployment.

It is a further object of this invention to provide a means to deploy and retract the canopy in an automated manner.

It is a further object of this invention to extend and retract the canopy of the umbrella from within the central shaft so that, after immediate use, residual water from the canopy is contained within the shaft, thus obviating the need to exercise caution as to where to place the umbrella after use.

An added benefit of the invention is to provide a squeegee element that assists with removing water from the canopy as it is retracted into the central shaft.

SUMMARY OF THE INVENTION

The apparatus comprises an umbrella having a central shaft, a canopy assembly, and a motorized gearing assembly that automatically extend and retract a canopy from a top end the central shaft. The central shaft is provided with a battery section to hold at least one (1) battery to supply electrical power to the motor assembly. Another battery section is provided for storage of extra batteries. A control switch enables selective control of the connectivity between each battery and the motor assembly.

The canopy assembly comprises a canopy affixed to a plurality of ribs. Each rib is a semi-rigid member that flexes without plastic deformation. The canopy assembly configuration is such that, when deployed and in an extended state, a preferential curvature is formed to force an outer edge of the canopy downward. The canopy extends from within the central shaft when being deployed and retracts back into the central shaft when being stowed. During deployment, each rib protrudes from a top opening of the shaft and is forced in a tangential direction, whereby the preferential curvature forces the canopy assembly to take an extended and downward shape. During retraction, each rib withdraws back into the top opening of the shaft and is forced in a centripetal direction, whereby each rib draws back into the shaft. As the canopy assembly is retracted into the shaft, the canopy makes contact with a squeegee member located at the top of the shaft. This squeegee member wipes clear water that has wetted the canopy as the canopy is drawn across the squeegee member. The configuration of the squeegee member is such that it forces the water to collect onto the squeegee and fall from the apparatus.

Distal ends of each rib are attached to the motorized gearing assembly, which is housed within the central shaft, and comprises a worm gear along with moving plates. A cap is provided at a top of the shaft to cover the opening of the shaft and provided a channel through which the canopy assembly travels. The cap also directs each rib in the preferred direction as the canopy assembly is extended and retracted. The motor comprises a reversible, direct current, stepper motor with a cylindrical output shaft. The motor is further provided with an encoder to track the location of a rotor to obviate overextension in any one (1) direction. The control switch enables selective supply of electrical power to the motor for rotation of the motor in either direction, which in turn drives the worm gear in a desired direction. Driving the worm gear in a first direction forces the canopy assembly out of the shaft, whereas driving the worm gear in a second direction forces the canopy assembly into the shaft.

The shaft comprises a shell with a plurality of channels and grooves that guide the motorized gearing assembly. Each moving plate of the motorized gearing assembly is equipped with corresponding grooves to interlock with the groves of the shell. The channels enable each rib to be guided within the shaft as the canopy assembly traverses the length of the shaft during operation. The plurality of plates forms a pivot assembly that enables controlled and selected traversing motion about the worm gear. As the motor is energized in a given rotational direction, the worm gear rotates and the pivot assembly traverses the worm gear causing the ribs to deflect against the cap and squeegee. As the ribs deflect, the canopy assembly exits the central shaft and results an umbrella canopy formation. The processor and encoder interrupt electrical power when the pivot assembly has traversed a pre-determined distance of the shaft so as to prevent over extension. As the motor is energized in an opposite direction, the worm gear rotates and the pivot assembly traverses the worm gear causing the ribs to be guided in by the cap and squeegee. As the ribs are guided, the canopy assembly retracts into the central shaft. The processor and encoder interrupt electrical power when the pivot assembly has traversed a pre-determined distance of the shaft so as to prevent over retraction.

Surfaces of the central shaft and the canopy may be provided with indicia for display to improve the aesthetics and appeal of the apparatus.

Furthermore, the described features and advantages of the disclosure may be combined in various manners and embodiments as one skilled in the relevant art will recognize. The disclosure can be practiced without one (1) or more of the features and advantages described in a particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

Figure 1:
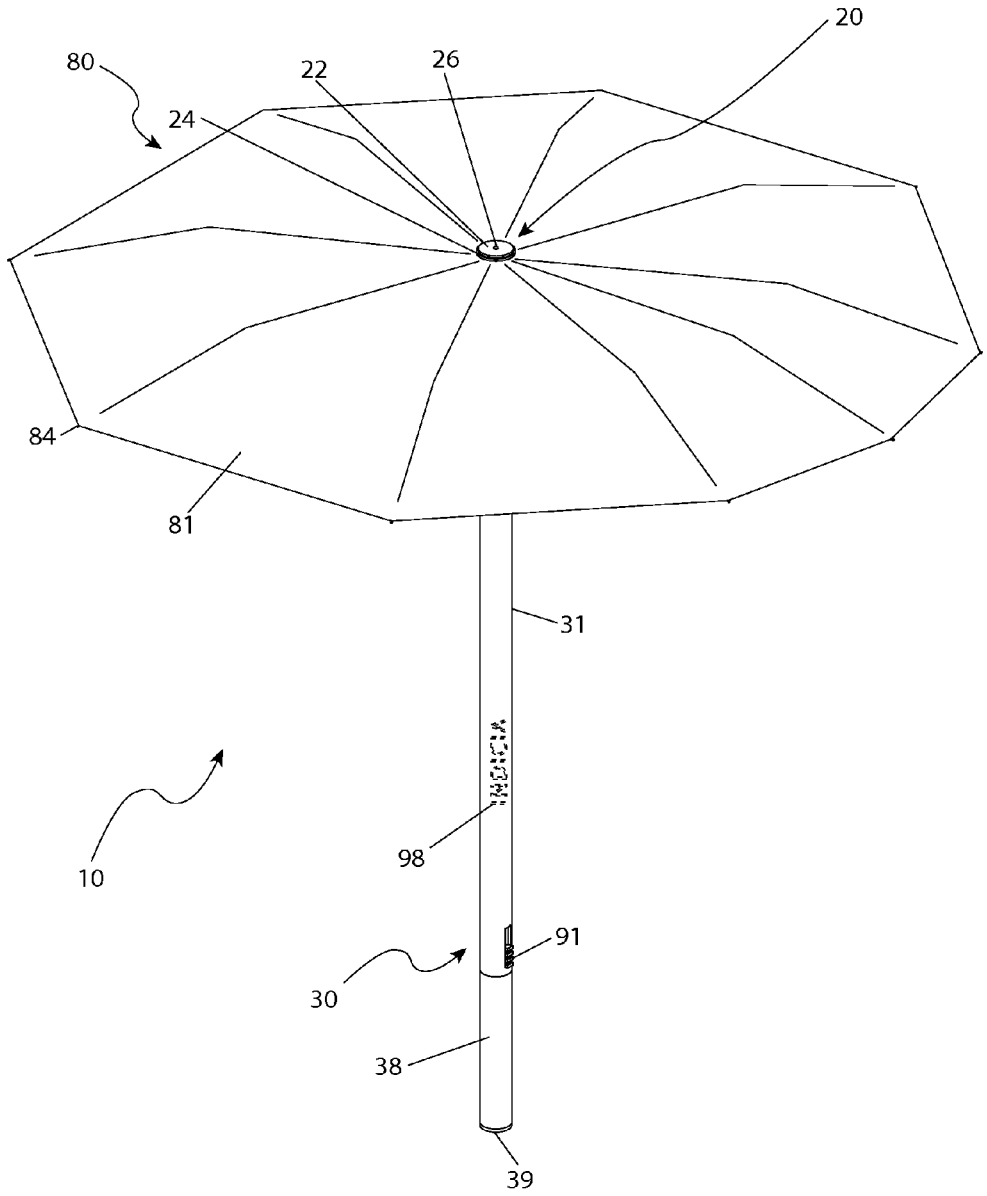
FIG. 1 is an elevation view of a retractable umbrella 10 in a deployed arrangement in accordance with the preferred embodiment of the present invention.

10 retractable umbrella
20 floating cap assembly
22 plate
24 squeegee
26 fastener
27 lock washer
29 gap
30 tube assembly
31 shell
32 crenel
33*a* spline groove
33*b* rib groove
34 land
35*a* first snap ring groove
35*b* second snap ring groove
36 internal thread
37 external thread
38 battery section
39 end cap
40 drive assembly
41 motor
42 motor shaft
43 shaft flat
44 encoder
48 drive coupling
49 set screw
51 worm gear
52 worm shaft
54 flight
55 landing
56 threaded aperture
58*a* first snap ring
58*b* second snap ring
60 rib pivot assembly
61 rib pivot top
62 upper pivot groove
63 parallel key spline
64 channel
66 rib pivot bottom
67 lower pivot groove
68 pivot bottom channel
71 core
72 core flight
73 core flat
74 core base
75 core tooth
76 tooth trough
77 base channel
78 rib rotating ring
79 ring opening
80 canopy assembly
81 cloth

82 rib
83 rib eye
84 rib tip
85 rib curve
91 switch
92 battery compartment
93 battery
94 battery contact
95 spare battery compartment
96 spare battery
97 processor
98 indicia

DETAILED DESCRIPTION OF THE PREFERRED EMBODIMENT

In accordance with the invention, the best mode is presented in terms of a preferred embodiment, herein depicted within FIGS. 1 through 6. However, the disclosure is not limited to a single described embodiment and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only one particular configuration may be shown and described for purposes of clarity and disclosure and not by way of limitation of scope.

The terms "a" and "an" herein do not denote a limitation of quantity, but rather denote the presence of at least one of the referenced items.

The present invention describes a retractable umbrella (herein referred to as the "apparatus") 10, which provides a means to deploy an umbrella in the unique manner of extending a rain-protective canopy assembly 80 from a distal end of a carrying tube assembly 30 and collapsing the canopy assembly 80, after use, back into the carrying tube assembly 30.

Referring now to FIG. 1, an elevation view of the apparatus 10 in an extended position according to the preferred embodiment of the present invention, is disclosed. The tube assembly 30 is comprised preferably of a thermoplastic material and constructed from a plurality of injection-molded parts to form the shell 31, the battery section 38, and the end cap 39. The proximal end of the shell 31 is provided with an internal thread 36 (see FIG. 3) into which the external thread 37 (see FIG. 3) on the battery section 38 are attached. A three-position switch 91, which controls a drive motor 41 (see FIG. 3), is disposed in the shell 31 in proximity to the internal threads 36.

The battery compartment 92 (see FIG. 3) and the spare battery compartment 95 (see FIG. 3) comprise opposite ends of the battery section 38. Each end of the battery section 38 is equipped with external threads 37 (see FIG. 3) for attachment of, or to, successive portions of the tube assembly 30, the difference being that the battery compartment 92 (see FIG. 3) is provided with battery contacts 94, (see FIG. 3) to complete the electrical circuitry. The threaded connection of the battery section 38 to the shell 31 improves the efficacy of servicing the batteries 93 (see FIG. 3). An end cap 39, also provided with internal thread 36 (see FIG. 3), is attached to the proximal end of the battery section 38 for convenient access to the spare batteries 96 (see FIG. 3).

It is envisioned that some surface portions of the tube assembly 30, or the canopy assembly 80 may comprise various indicia 98 which may provide script or logos based upon a user's preference and may include images such as, but not limited to, business names/logos, personal names, symbols, lines, pictures, and the like, in various colors and patterns, to further customize and personalize the apparatus 10.

Figure 3:
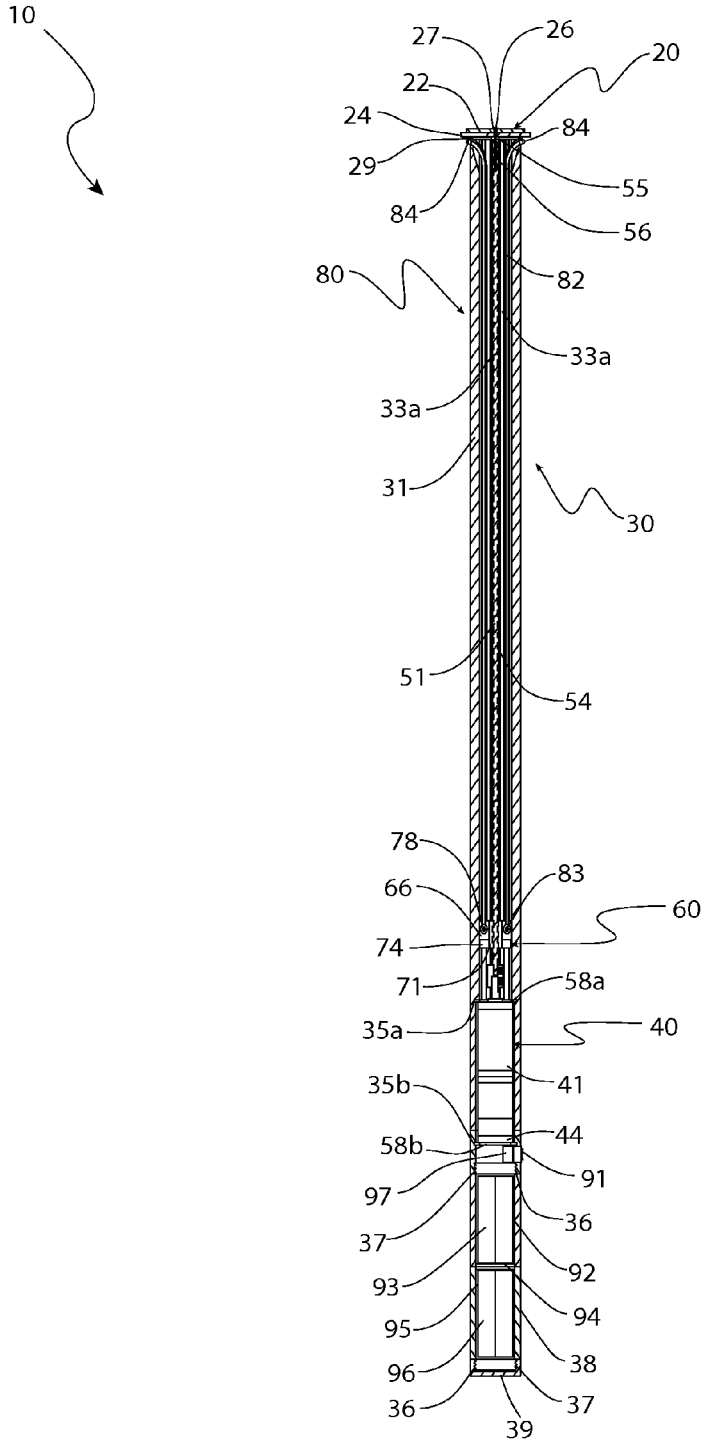
FIG. 3 is a section view along line A-A as seen in FIG. 2*a* of the retractable umbrella 10 depicted with a rib pivot assembly 60 and a canopy assembly 80 in a fully retracted position in accordance with the preferred embodiment of the present invention.

The canopy assembly 80 comprises a cloth 81 supported on and attached to a plurality of formed ribs 82 (see FIG. 3). The cloth 81 may be comprise a single piece of material, or a plurality of pieces stitched, or otherwise fastened together, to form a covering layer over the extended ribs 82 (see FIG. 3) to protect a user from rain. The cloth 81 may be a woven nylon, or some such material, provided with some measure of impermeability to water. The cloth 81 may be cut on the bias to take advantage of certain characteristics inherent in textile preparation and finishing, and further provided with a hem in either a straight of scalloped configuration. The cloth 81 may be of a single color, or alternately, of more than one (1) color pieced together in any manner to suit the taste of a user.

The ribs 82 (see FIG. 3) preferably comprise a semi-rigid thermoplastic material having a good measure of flexibility, yet being able to return to a shape capable of supporting the cloth 81 with a taut presentation. Disposed at the proximal end of each rib 82 is a rib eye 83, which is generally a torus comprised of the same constituent material as the rib 82, as shown in FIG. 3. The distal end of each rib 82 (see FIG. 3) is formed with a preferential rib curve 85 (see FIG. 4), which turns the outer edge of the canopy assembly 80 downward in order to present a more favorable profile in a windy condition. The cloth 81 is fastened to the ribs 82 (see FIG. 3) in a plurality of locations by the use of adhesives, or other means, to keep said cloth 81 from gathering too much in one (1) location, or from stretching askew. The cloth 81 is secured to the end of each rib 82 (see FIG. 3) and covered with a protective, preferably rubberized, rib tip 84.

Figure 2A:
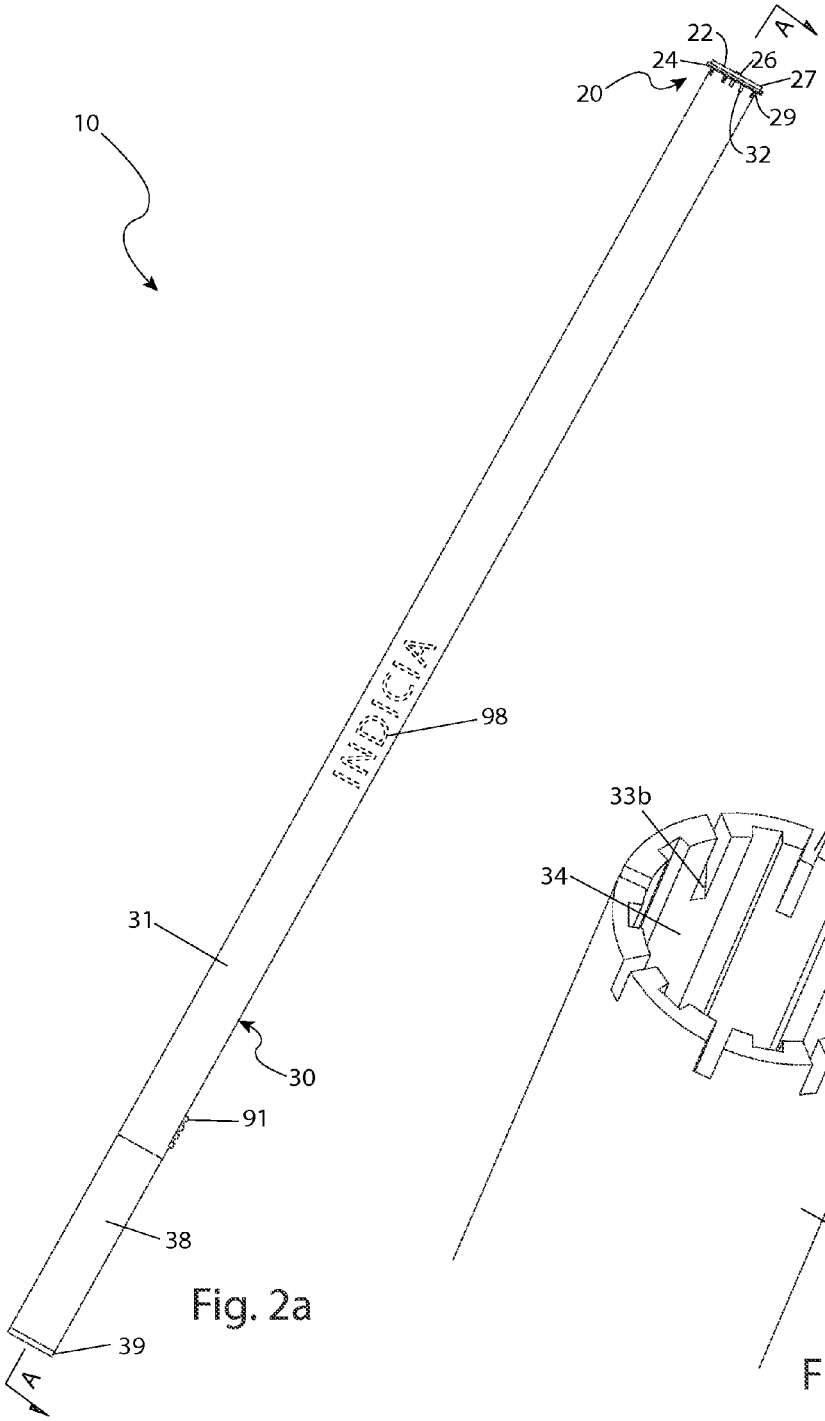
FIG. 2*a* is an isometric view of the retractable umbrella 10 in a collapsed arrangement in accordance with the preferred embodiment of the present invention.
Figure 2B:
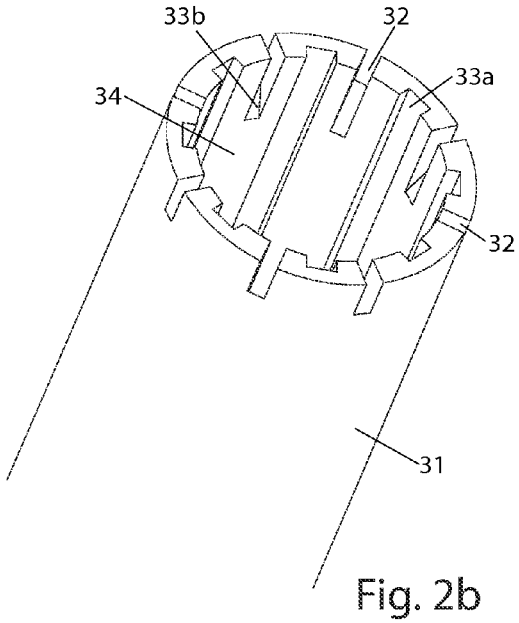
FIG. 2*b* is an enlarged isometric view of the distal end of a shell 31 showing the crenels 32 for the ribs 82 of the retractable umbrella 10 in accordance with the preferred embodiment of the present invention.

Referring to FIG. 2*a*, an isometric view of the apparatus 10, and FIG. 2*b*, an enlarged isometric view of the distal end of the shell 31 according to the preferred embodiment of the present invention, are disclosed. A floating cap assembly 20 is located at the distal end of the tube assembly 30. The floating cap assembly 20 comprises a squeegee 24 and a backing plate 22 attached to the distal end of a centrally located worm gear 51 (see FIG. 3) preferably by means of a threaded fastener 26. The squeegee 24 preferably comprises a circular piece of a nitrile compound having a durometer suitable for the intended purpose of wiping water from the cloth 81 (see FIG. 1) as the canopy assembly 80 (see FIG. 1) is retracted into the shell 31. The plate 22 preferably comprises a circular piece of thermoplastic intended to hold the squeegee 24 in contact with the cloth 81 (see FIG. 1). It is understood that other materials may be utilized in the fabrication of the squeegee 24 and the plate 22 without limiting the scope of the apparatus 10. The plate 22 and the squeegee 24 are both provided with a central aperture (not shown) to be secured by the fastener 26. The prevailing torque on the fastener 26 is maintained by the use of a lock washer 27. The lock washer 27 preferably comprises a metal internal star lock washer; however, other types and materials may be substituted without changing the scope of the apparatus 10. The floating cap assembly 20 does not contact the shell 31 at any time and provides a gap 29 through which the canopy assembly 80 (see FIG. 3) passes for deployment.

The shell 31 is formed with a plurality of alternate internal lands 34 and spline grooves 33*a* equally spaced around the perimeter and oriented along the longitudinal axis of said shell 31. The spline grooves 33*a* in the shell 31 accommodate the parallel key splines 63 (see FIG. 6) of the rib pivot assembly 60 (see FIG. 6). The spline grooves 33*a* extend from the distal end of the shell 31 to a point along the interior of said shell 31 to correspond to the maximum length of travel for the rib pivot assembly 60 (see FIG. 6).

The rib grooves 33*b* are formed in the middle portion of the internal lands 34 at the distal end of the shell 31. These rib grooves 33*b* primarily direct the ribs 82 (see FIG. 3) out of the shell 31 through the gap 29 between said shell 31 and the floating cap assembly 20. The rib grooves 33*b* are oriented at an angle to the face of the lands 34 and end as crenels 32 in the wall of the shell 31. The crenels 32 provide the actual spaces for the passage of the ribs 82 (see FIG. 3) while the cloth 81 (see FIG. 1) of the canopy assembly 80 (see FIG. 1) is accommodated in the gap 29.

Figure 4:
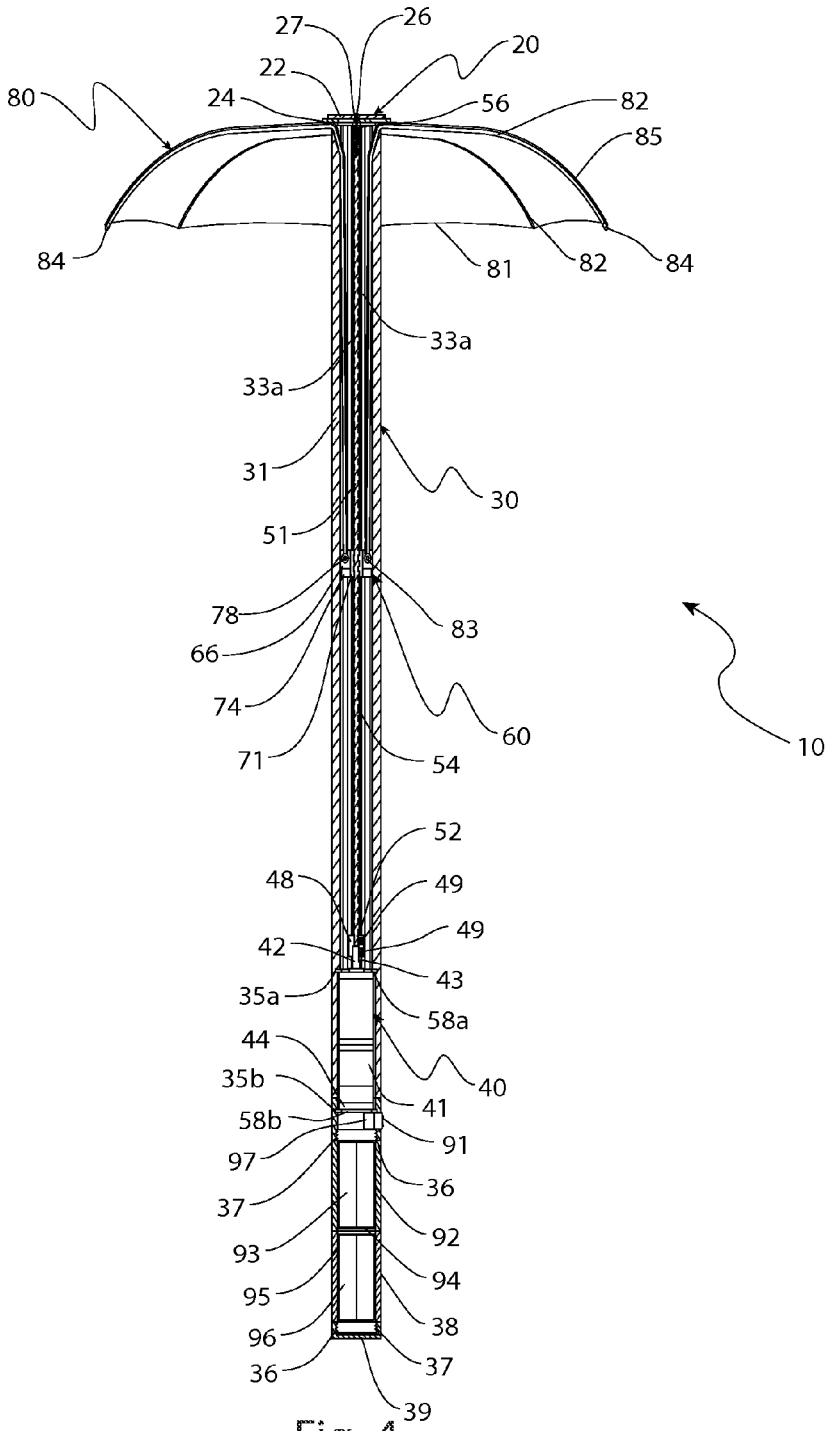
FIG. 4 is a developed section view of the retractable umbrella 10 depicted with the rib pivot assembly 60 and the canopy assembly 80 in a partially extended position in accordance with the preferred embodiment of the present invention.
Figure 5:
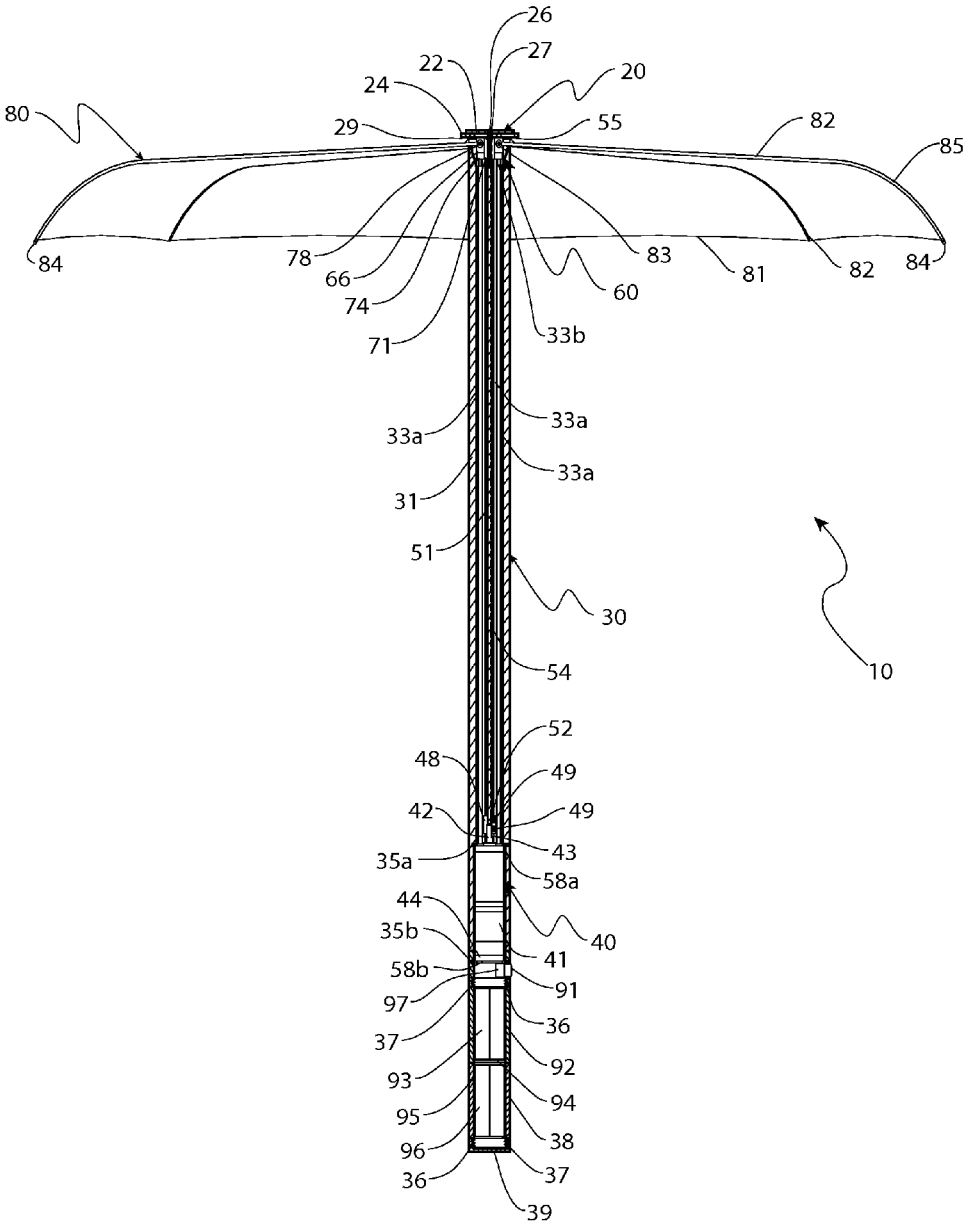
FIG. 5 is a developed section view of the retractable umbrella 10 depicting the canopy assembly 80 in a fully deployed arrangement in accordance with the preferred embodiment of the present invention; and, FIG. 6 is an exploded isometric view of the rib pivot assembly 60 of the retractable umbrella 10 in accordance with the preferred embodiment of the present invention.

Referring now to FIGS. 3, 4, and 5, section views of the apparatus 10, in various stages of deployment, according to the preferred embodiment of the present invention, are disclosed. A motor 41 is retained in the shell 31 by a first snap ring 58*a* placed into a first snap ring groove 35*a* and a second snap ring 58*b* placed into a second snap ring groove 35*b*. The snap rings 58*a*, 58*b* are common internal snap rings of a size appropriate to the diameter of the shell 31 and the diameter of the housing of the motor 41 provided with two (2) apertures for installation and removal with standard needle-nosed snap ring pliers. It may be necessary to incorporate other provisions into the shell 31 to stay any additional undesirable relative movement of the housing of the motor 41, however, it is understood that any such eventualities do not modify the scope or intent of the present apparatus 10 and this preferred embodiment does not preclude any other embodiment.

The motor 41 comprises any of a variety of commercially available, copper wound, low voltage, small frame, reversible, direct current, stepper motors 41 with a cylindrical output shaft 42, preferably equipped with a shaft flat 43 capable of generating sufficient torque to induce the desired motion in the rib pivot assembly 60. The motor 41 is provided with an encoder 44, which tracks the precise location of the rotor to assure that the drive assembly 40 is not overdriven in any one (1) direction. The motor 41 is electrically powered, through a three-position switch 91 and the processor 97, by the battery 93 located within the battery compartment 92. A set of spare batteries 96 can be carried on board the apparatus 10 in the spare battery compartment 95.

The three-position switch 91 preferably has two (2) momentarily "ON" positions, one (1) to raise, or deploy the canopy assembly 80, and one (1) to retract said canopy assembly 80, and a spring-biased neutral position in which no power flows to the motor 41. The output from the encoder 44 on the motor 41 is translated through the processor 97 to assure that said motor 41 has not reached the maximum number of turns of the output shaft 42 in any direction prior to energizing said motor 41 in that direction.

A first end of a drive coupling 48 is attached to the output shaft 42 of the motor 41 and secured with a set screw 49 oriented on the shaft flat 43. The set screw 49 is preferably of a cup-point style with a hex socket, although other styles could alternately be used. The second end of the drive coupling 48 is attached to a worm shaft 52 of a worm gear 51. A second set screw 49 is disposed in the second end of the drive coupling 48 to clamp said drive coupling 48 onto the worm shaft 52 in order to positively connect the output shaft 42 of the motor 41 to the worm gear 51. The drive coupling 48 is preferably any of a variety of rigid couplings having a bore in the first end matching the output shaft 42 and a bore in the second end appropriately sized to accommodate the worm shaft 52.

The worm gear 51 is comprised of a thin, cylindrical worm shaft 52 having a single, raised, rectangular, helical flight 54 uniformly disposed upon the outside diameter of said worm shaft 52. A cylindrical landing 55 is disposed on the distal end of the worm gear 51 and forms the terminus of the flight 54. A threaded aperture 56 is centrally disposed in the landing 55 for the attachment of the floating cap assembly 20. The flight 54 of the worm gear 51 is engaged in a corresponding feature, namely the core flight 72 (see FIG. 6), in the core 71 of the rib pivot assembly 60.

Figure 6:
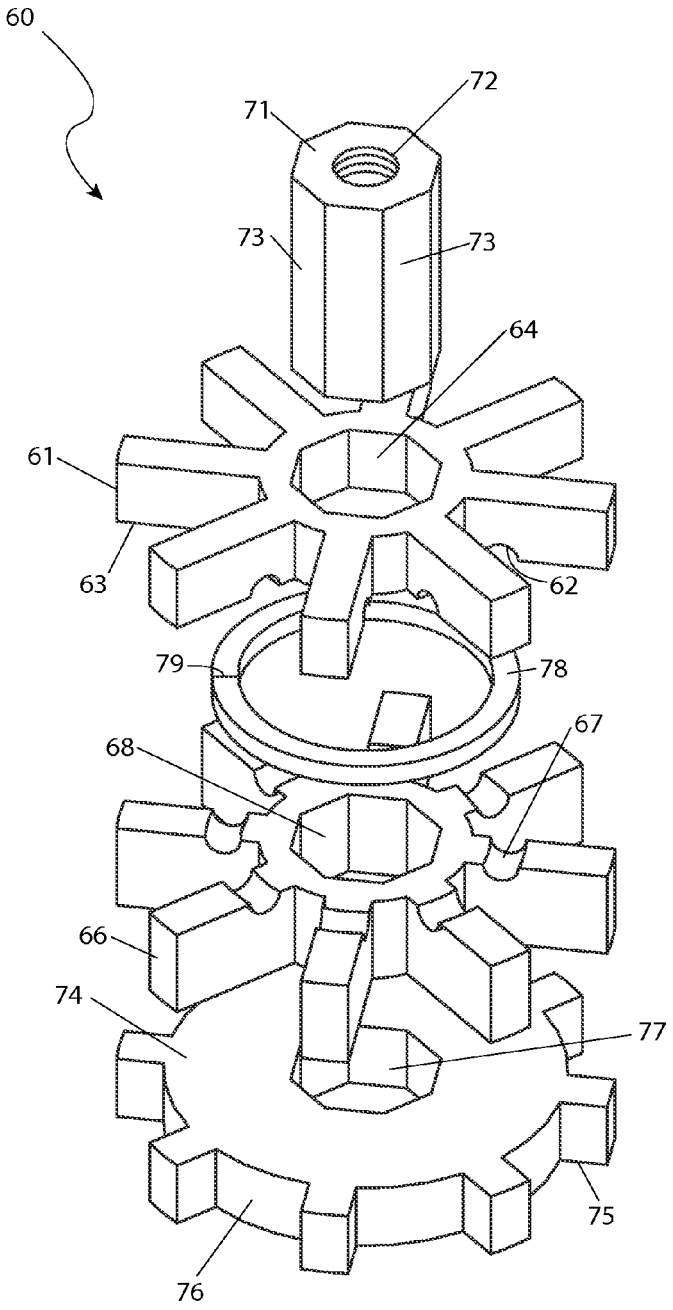

Referring now to FIG. 6, an exploded isometric view of the rib pivot assembly 60, of the apparatus 10, according to the preferred embodiment of the present invention, is disclosed. The rib pivot assembly 60 is comprised preferably of a thermoplastic material and constructed from a plurality of injection-molded parts to form a rib pivot top 61, a rib pivot bottom 66, the core 71, and a core base 74. The rib pivot top 61 is generally an annular ring having a plurality of parallel key splines 63 projecting radially outward and a polygonal pivot top channel 64 having a number of planar faces equivalent to, and perpendicular to the longitudinal axis of said parallel key splines 63. Disposed in a lower face of each parallel key spline 63 is a portion of an upper pivot groove 62 arranged such that the center of said upper pivot groove 62 coincides with the center of the pivot top channel 64. The rib pivot bottom 66 is an annular ring also having a plurality of parallel key splines 63 projecting radially outward from a polygonal pivot bottom channel 68 having a number of planar faces equivalent to, and perpendicular to the longitudinal axis of said parallel key splines 63. Disposed in an upper face of each parallel key spline 63 is a portion of a lower pivot groove 67 arranged such that the center of said lower pivot groove 67 coincides with the center of the pivot bottom channel 68. A rib rotating ring 78, comprised preferably of a steel, or some other metal, and coated or plated with a corrosion inhibiter, is formed in a circle having a generally square cross-section and a ring opening 79. It is understood that other materials may be substituted in the fabrication of the rib rotating ring 78 without limiting the scope of the apparatus 10.

The core base 74 is generally a toothed wheel having a plurality of base teeth 75 equivalent in number and profile to the parallel key splines 63. The outer diameter of the core base 74 is such that said core base 74 can be fit into the spline grooves 33*a* (see FIG. 5) in the shell 31 (see FIG. 5). The tooth troughs 76 between the base teeth 75 are cut, or formed, to a diameter that permits a sliding fit between the lands 34 (see FIG. 2*a*) of the shell 31 (see FIG. 5). The core base 74 is provided with a polygonal base channel 77 matching the pivot top channel 64.

The core 71 is generally an extended polygon with a plurality of core flats 73 to match the planar faces of the pivot top channel 64. Disposed in the center of the core 71 is a core flight 72 which is the inverse of the worm gear 51 (see FIG. 3) such that said worm gear 51 (see FIG. 3) can be inserted into said core 71, and further that rotation of said worm gear 51 (see FIG. 3) in either direction will cause said core 71 to traverse the length of said worm gear 51 (see FIG. 3) if said core 71 is held from similarly rotating.

The rotating ring 78 is deformed to further enlarge the ring opening 79 in order that said rotating ring 78 may be inserted into the rib eye 83 (see FIG. 5) of each individual rib 82 (see FIG. 5) with the rib curves 85 (see FIG. 5) oriented outwardly. The rotating ring 78 is then deformed back into the original configuration. The rotating ring 78 is placed into the upper pivot groove 62 of the rib pivot top 61 and the ribs 82 (see FIG. 5) are arranged to be spaced between each parallel key spline 63. The rib pivot bottom 66 is attached, with an appropriate adhesive, or some other means, to the rib pivot top 61 such that the lower pivot groove 67 is in juxtaposition with the upper pivot groove 62 and the rotating ring 78 is captured between said rib pivot top 61 and rib pivot bottom 66 and all parallel key splines 63 are aligned with one (1) rib 82 (see FIG. 5) between each parallel key spline 63. The core base 74 is attached to the rib pivot bottom 66 with an appropriate adhesive, or some other means, such that the core teeth 75 are aligned with the parallel key splines 63 of the rib pivot bottom 66. The core 71 is attached with an appropriate adhesive, or some other means, into the aligned pivot top channel 64, pivot bottom channel 68, and the base channel 77.

In FIG. 3 the rib pivot assembly 60 (see FIG. 5) is located near the proximal end of the worm gear 51. The ribs 82 are arranged vertically with the rib eyes 83 so as to be engaged in the rotating ring 78, and the rib tips 84 are arranged to be protruding from the crenels 32 (see FIG. 2*a*). The cloth 81 (see FIG. 1) lies along the ribs 82 inside of the shell 31. As the three (3) position switch 91 is engaged in the "UP" position, the motor 41 is energized thus turning the worm gear 51. The parallel key splines 63 (see FIG. 6) of the rib pivot assembly 60 (see FIG. 6) are engaged into the spline grooves 33*a* of the shell 31 thus preventing said rib pivot assembly 60 (see FIG. 6) from turning with the worm gear 51. The rib pivot assembly 60 (see FIG. 6) traverses up the worm gear 51 causing the ribs 82 to deflect against the squeegee 24 and the backing plate 22 and forcing said ribs 82 to exit the shell 31 through the crenels 32 (see FIG. 2*a*). The cloth 81 (see FIG. 1) exits the shell 31 through the gap 29 at the floating cap assembly 20. The rib curve 85 (see FIG. 5) naturally configures the canopy assembly 80 to turn downwardly.

FIG. 5 depicts the apparatus 10 in the fully deployed configuration as though the switch 91 were held engaged in the "UP" position. In this position, the encoder 44, located on the motor 41, has given the processor 97 an output shaft 42 rotational count equivalent to the canopy assembly 80 being fully deployed with the rib pivot assembly 60 being in contact with the landing 55 at the distal end of the worm gear 51. The processor 97 interrupts the electrical circuit between the switch 91, the batteries 93, and the motor 41 and will not permit the rib pivot assembly 60 to be overdriven. The ribs 82 have pivoted about the rib rotating ring 78 and are arranged in a more or less horizontal configuration with the rib curve 85 pointed downward and the cloth 81 stretched taut. Retracting the canopy assembly 80 can be accomplished by engaging the three-position switch 91 in the "DOWN" position, thereby reversing the motor 41 and the connected worm gear 51.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the enabled user in a simple and straightforward manner with little or no training. The apparatus 10 would be configured as indicated in FIG. 2 upon the initial purchase or acquisition.

The method of utilizing the apparatus 10 may be achieved by performing the following steps: acquiring a model of the apparatus 10 having a desired style to suit the taste of the user; detaching the battery section 38 from the shell 31; installing the proper number and style of batteries 93 in the correct orientation into the battery compartment 92; installing spare batteries 96 into the spare battery compartment 95 as desired; reattaching the battery section 38 to the shell 31; pressing and holding the "UP" position of the switch 91 until such time as the canopy assembly 80 is completely raised; travelling to the desired destination under the protection of the canopy assembly 80; and pressing and holding the "DOWN" position of the switch 91 until such time as the canopy assembly 80 is drawn back into the shell 31.

The apparatus 10 is provided with the spare battery compartment 95 so that a fresh set of spare batteries 96 can be carried on-board so as to avoid a loss of power in a time of need.

The foregoing descriptions of specific embodiments have been presented for purposes of illustration and description. They are not intended to be exhaustive or to limit to the precise forms disclosed and many modifications and variations are possible in light of the above teachings. The embodiments were chosen and described in order to best explain principles and practical application to enable others skilled in the art to best utilize the various embodiments with various modifications as are suited to the particular use contemplated.

What is claimed is:

1. A retractable umbrella comprising:

a tubular shaft, having a top end and a bottom end; wherein:

an inside surface of said tubular shaft is provided with a plurality of longitudinal grooves spaced equidistant from each other beginning at said top end and extending a majority of a length of said tubular shaft; and, a plurality of canted grooves are spaced equidistant from each other existing only at said top end, positioned at interstitial locations of said longitudinal grooves, forming crenels at said top end;

a worm gear situated within said tubular shaft, wherein:

said worm gear is provided with a central shaft, provided with a helical flight uniformly disposed upon an outside diameter thereof; and, a landing is located at an upper portion of said central shaft;

a rib pivot assembly located within said tubular shaft and slidably movable along a longitudinal length of said tubular shaft inside surface, wherein:

said rib pivot assembly is provided with a core;

said core is provided with a flight at a central portion thereof to receive and facilitate rotational motion of said worm gear and to enable said core to traverse said tubular shaft in a longitudinal direction;

said rib pivot assembly is provided with a wheel pivot top, comprising:

a first perimeter edge having a plurality of first teeth in a coinciding and complementary profile with said longitudinal grooves;

a first center provided with a first aperture complementary in profile to receive said core; and, wherein a bottom surface of each of said first teeth is provided with a first receiving channel;

said rib pivot assembly is provided with a wheel pivot bottom, comprising:

a second perimeter edge having a plurality of second teeth in a coinciding and complementary profile with said longitudinal grooves;

a second center provided with a second aperture complimentary in profile to receive said core;

wherein a top surface of each of said second teeth provided with a second receiving channel; and, said rib pivot assembly is provided with a wheel rotating ring comprising an annulus that fits within said first and second receiving channels;

said rib pivot assembly is provided with a wheel base, comprising:

a third perimeter edge having a plurality of third teeth in a coinciding and complementary profile with said longitudinal groves; and, a third center provided with a third aperture complimentary in profile to receive said core;

a plurality of ribs extending from said rib pivot assembly, wherein:

each rib is a semi-rigid, flexible material, having a first end and a second end;

each first end is provided with an engaging member to attach to said wheel rotating ring; and, each second end has a torus at a terminus thereof;

a canopy fastened to each rib;

a floating cap threadingly attached to an upper portion of said worm gear configured such that a gap is maintained between said floating cap and said tubular shaft;

a first compartment, wherein:

said first compartment is a first chamber adapted to hold at least one battery;

said first compartment is provided with electrical connectors;

said first compartment is provided with a top end thereof to removably secure said first compartment to said bottom end of said tubular shaft; and, said first compartment is provided with a bottom end thereof;

a second compartment, wherein:

said second compartment is a second chamber adapted to hold at least one battery;

said second compartment is provided with a top end thereof, thereby dividing said second compartment from said first compartment bottom end; and, said second compartment is provided with a threaded configuration at a bottom end thereof;

a cap removably secured to said bottom end of said second compartment;

a driving means for operably moving said rib pivot assembly; and, wherein said core, said wheel pivot top, said wheel pivot bottom, said wheel rotating ring, and said wheel base are affixed to each other to align each of said first, second, and third teeth.

2. The retractable umbrella recited in claim 1, further comprising a rubber tip affixed to an end of each torus.

3. The retractable umbrella recited in claim 1, wherein each rib has a preferential curvature.

4. The retractable umbrella recited in claim 1, wherein said canopy comprises a material that is impermeable to water.

5. The retractable umbrella recited in claim 1, wherein said canopy comprises a plurality of segmented sheets fastened together.

6. The retractable umbrella recited in claim 1, further comprising a squeegee surrounding said canopy to wipe fluid from said canopy.

7. The retractable umbrella recited in claim 6, wherein said squeegee has a circular shape.

8. The retractable umbrella recited in claim 6, wherein said squeegee is a nitrile compound.

9. The retractable umbrella recited in claim 6, further comprising a rigid plate to securely abut said squeegee against said canopy.

10. The retractable umbrella recited in claim 9, wherein said rigid plate is circular.

11. The retractable umbrella recited in claim 1, further comprising a locking washer placed between said floating cap and said worm gear to maintain securement of said floating cap with said worm gear while said umbrella is extended and retracted.

12. The retractable umbrella recited in claim 1, further comprising:

an electric motor in electrical connection with said electrical connectors and in mechanical connection with said rib pivot assembly to actuate said rib pivot assembly, wherein said electric motor provided with an output shaft to convert electrical power to rotational work energy;

a drive shaft coupled to said output shaft and to said central shaft of said worm gear to enable said worm gear to engage work output of said electric motor;

an electro-mechanical switching means in electrical communication with said electrical connectors and said electric motor to open and close electrical switches between said electrical connectors and said electrical motor, wherein:

said electro-mechanical switching means is provided with a processor to perform algorithmic functions of signal inputs of said electro-mechanical switching means to generate signal outputs to said electro-mechanical switching means; and, said electro-mechanical switching means is provided with a control switch assembly disposed on an outside surface of said tubular shaft to transmit input signals of a user to said processor.

13. The retractable umbrella recited in claim 12, further comprising:

an encoder placed into electrical communication with said electric motor and said processor to track and record rotational motion data of said electric motor in any direction and relay a signal containing said data to said processor;

wherein said processor registers said rotational motion and communicates with said electric motor to cease rotation if a pre-determined level or rotational motion in any one direction is detected.

14. The retractable umbrella recited in claim 12, wherein:

said electric motor is a reversible, direct current, stepper motor; and, said control switch assembly and electro-mechanical switching means are configured to supply electric power to operate the electric motor in a first direction, operate the electric motor in a second direction, or interrupt electrical power to said electrical motor;

wherein a user selectively activates said electric motor in said first direction, said second direction, or interrupts electrical power via manual operation of said control switch assembly.

15. The retractable umbrella recited in claim 1, wherein said tubular shaft is generally cylindrical in shape.

16. The retractable umbrella recited in claim 1, wherein said tubular shaft is plastic.

17. The retractable umbrella recited in claim 1, wherein said wheel rotating ring is steel.

18. The retractable umbrella recited in claim 17, further comprising a corrosion inhibiting coating encasing said wheel rotating ring.

19. The retractable umbrella recited in claim 1, wherein said core, said wheel pivot top, said wheel pivot bottom, said wheel rotating ring, and said wheel base are affixed to each other via an adhesive.

20. The retractable umbrella recited in claim 1, wherein said canopy is fastened to each rib via an adhesive.

* * * * *